US006948542B2

(12) United States Patent
Abouloukme

(10) Patent No.: US 6,948,542 B2
(45) Date of Patent: Sep. 27, 2005

(54) RETRACTABLE SELF ROLLING BLIND AWNING OR COVER APPARATUS

(76) Inventor: Issam Abouloukme, P.O. Box 90, Sylvania, NSW (AU), 2224

( * ) Notice: Subject to any disclaimer, the term of this patent is extended or adjusted under 35 U.S.C. 154(b) by 44 days.

(21) Appl. No.: 10/469,714

(22) PCT Filed: Mar. 6, 2002

(86) PCT No.: PCT/AU02/00252

§ 371 (c)(1),
(2), (4) Date: Feb. 5, 2004

(87) PCT Pub. No.: WO02/070854

PCT Pub. Date: Sep. 12, 2002

(65) Prior Publication Data

US 2004/0140063 A1 Jul. 22, 2004

(30) Foreign Application Priority Data

Mar. 6, 2001 (AU) ..... PR3513
Mar. 14, 2001 (AU) ..... PR3694
Apr. 26, 2001 (AU) ..... PR4568

(51) Int. Cl.[7] ..... A47H 1/00
(52) U.S. Cl. ..... 160/24; 160/122
(58) Field of Search ..... 160/24, 122, 243, 160/245; 4/502

(56) References Cited

U.S. PATENT DOCUMENTS 2,886,047 A * 5/1959 Healy ..... 135/95
4,195,370 A * 4/1980 Budd ..... 4/502
4,407,027 A * 10/1983 Colon, Jr. ..... 4/502
4,466,143 A * 8/1984 Lamb ..... 4/502
5,685,354 A * 11/1997 Kim ..... 160/122

* cited by examiner

*Primary Examiner*—David Purol
(74) *Attorney, Agent, or Firm*—Molins & Co.

(57) ABSTRACT

A retractable self rolling blind, awning or cover apparatus (11), is disclosed in which there are two or more sheets of fabric or other suitable material (17) affixed and wound conjointly about a keyway tube (12) which is supported between suitable brackets (14) mounted on a tension bar (15). The keyway tube is mounted so that it is parallel with the tension bar and the tube is fitted with a conventional spring mechanism for use with blinds, awnings and the like. The spring mechanism is pretensioned so as to cause the sheets of fabric to be rewound about the keyway tube when one or more of the sheets of fabric is released from its extended or unwound position. The keyway tube and tension bar are allowed to travel during unwinding and winding up of the fabric, preferably assisted by providing either the ends of the tube itself, or the ends of the frame in which such tube is mounted, with wheels or pulleys (16) depending on the particular use to which the apparatus is to be put.

17 Claims, 4 Drawing Sheets

RETRACTABLE SELF ROLLING BLIND AWNING OR COVER APPARATUS

FIELD OF THE INVENTION

This invention relates to self-rolling apparatus based on a conventional spring mechanism for items such as blinds, awnings and covers. However, the invention should not be construed as being limited thereto and any similar arrangement where by the invention may be suitably adapted is meant to be encompassed including advertising screens and the like.

BACKGROUND OF THE INVENTION

Conventional spring blinds are provided with a so-called hollow keyway tube, onto which one end of suitable blind fabric or other material is attached, the remainder of the material being wrapped or rolled around the periphery of the tube. A spring mechanism is provided within the hollow tube, which is itself supported between suitable brackets. The blind fabric may be caused to unroll for any desired length (up to the limit of material rolled on the tube), usually by pulling on it, which causes the tube to rotate about its axis, thereby winding up (ie further tensioning) the spring mechanism. In a conventional, free-hanging blind, a locking means is also provided which prevents the spring from unwinding by itself. However, upon releasing the spring mechanism, the tube is able to re-roll the unfurled material back up onto itself.

Such an arrangement is particularly suitable for vertically hung blinds, although the same principles may be applied in other situations where a cover (eg swimming pool cover) or awning is required to extend over a specified area. However, where the blind or cover is not vertically hung, it will generally be found that the locking to secure the blind against re-rolling means (usually in the form of pins which act gravity) is not needed as the blind itself will be preferably held taught by means of some suitable arrangement such as a hook or catch arrangement.

In such situations however, especially in horizontal arrangements such as pool covers or external awnings, there is a limit to the useful span of cover which could be conveniently achieved (ie considering the length of material which may be unrolled), requiring larger spring mechanisms to accommodate increasing lengths of material to be extended and rewound. This of course means increasing difficulty of operation, as it becomes necessary to pull against the increasing tension of larger springs over increasing lengths of material required to be unrolled. Hence there are no known solutions for covering larger expanses.

OBJECT OF THE INVENTION

It is therefore an object of the present invention to overcome or at least ameliorate some or all of the foregoing disadvantages by providing an improved retractable rolling apparatus, relying in principle on the use of more than one sheet of material (and especially two sheets) rolled about the keyway tube of an otherwise conventional spring type blind or awning mechanism each of the sheets extending generally (but not necessarily) in opposite directions, so that in the case of two sheets of material pulled in opposite directions, the span of extended material is effectively doubled for each revolution of the tube, when compared with a single sheet.

In this way, the span covered by a particular size of spring mechanism may itself be effectively doubled. This follows from the fact that the spring is twisted by the rotation of the tube. For a given number of revolutions of the tube, double the coverage will be achieved. It will of course be appreciated that compared with conventional spring blind mechanisms in which the keyway tube remains supported between fixed brackets, the keyway tube in the present invention is free to travel as the self rolling apparatus is unwound, the free end of one fabric portion itself being securely anchored or attached (instead of the keyway tube being held in a fixed location as in a conventional arrangement).

It has been found that in order to adequately support the keyway tube, and prevent it from unwinding, a tension bar is required to be fitted parallel to the tube. The tube is then mounted in brackets, similar to conventional brackets for mounting typical spring type blinds, the brackets instead being appropriately located on the tension bar. This bar may be made from aluminum or steel or any other suitably strong but relatively light weight material.

DISCLOSURE OF THE INVENTION

According to the present invention there is provided a retractable self rolling blind, awning or cover apparatus, comprising two or more sheets of fabric or other suitable material affixed and wound conjointly about a keyway tube which is supported between suitable brackets mounted on a tension bar, the keyway tube being mounted so that it is parallel with the tension bar, the tube being fitted with a conventional spring mechanism for use with blinds, awnings and the like, the spring mechanism being pretensioned so as to causing the sheets of fabric to be rewound about the keyway tube when one or more of the sheets of fabric is released from its extended or unwound position, and wherein the keyway tube and tension bar are allowed to travel during unwinding and winding up of the fabric.

The tension bar is provided to prevent the spring from losing its tension. The tube is affixed by known means in conventional brackets located at suitable positions on the tension bar to hold the tube therein, thus forming as it were a frame like support structure.

Preferably, travel of the keyway tube/tension bar will be assisted by providing either the ends of the tube itself, or the ends of the frame in which such tube is mounted, with wheels or pulleys depending on the particular use to which the apparatus is to be put.

Thus, in one particular embodiment of the invention, where a surface is to be covered, such as a pool or sports ground area or over a glass root such wheels will assist the rolling of the tube, especially by keeping the fabric of the cover above the surface to be covered, thereby assisting with the rolling of the tube and its material. Where a single wheel is located on each end of the keyway tube itself or otherwise on the opposite ends of the frame but coaxial with the axis of the tube, this may be simply accomplished by having such wheels of larger diameter than the fully wound tube. Alternatively, and with advantage, a pair of wheels may be utilized on each end of the frame located a suitable distance away from the axis of the tube to provide the necessary clearance. This arrangement provides greater stability in preventing the tube from rewinding and is aesthetically perhaps more pleasing as smaller wheels may be utilized. In any event, any such wheels as just described may conveniently be allowed to travel freely over the surface or ground being covered or may be caused to run in appropriate grooves or tracks, in which case the position of the tracks themselves will also determine such clearance. It will also be understood that the position of any such wheels will depend on several factors in the design of the specific unit to be employed. But in any event, the wheels may be fitted as stated to the ends of the tube itself or to convenient positions adjacent the ends of the frame or tension bar or other support structure as described herein. Similarly any suitable roller type arrangement may be substituted for the wheels as such. Although several geometrical arrangements are thus possible, it has been found especially useful to have the tension bar located above the keyway tube where the embodiment functions as a cover. The preferred wheel arrangement utilizes pairs of wheels mounted on the ends of the frame for stability as mentioned.

Alternatively, in a particular embodiment more suitable for an awning, ie where the whole apparatus is effectively suspended above an area, or even below a ceiling (eg glass ceiling), the ends of the tube or the frame itself may be provided with pulleys instead of wheels, which are conveniently arranged to run on guide wires or the like to allow the tube to travel in the direction in which the blind or cover material is to be rolled/unrolled, but restricting lateral movement along the axis of the tube, thereby giving not only support but stability to the arrangement as a whole.

In embodiments utilized as awnings, it has been found that the preferred arrangement resides in having the tension bar below the keyway tube, with pulley wheels mounted directly on each end of the keyway tube, and hence located within the frame. Since the pulley wheels will then sit on the guide wires, the wires are thus encapsulated in the frame so that the unit cannot come of the wire supports.

To assist in this arrangement, small guide wheel pulleys are also provided on the tension bar at the points where, because it is suspended, it tends to turn upwards onto the guide wires. These additional pulleys thus reduce the friction and wear that would otherwise occur at that point.

It will generally be appreciated that in such any such arrangement described herein, one end of one sheet of fabric or material will itself be secured in a suitable position for its intended use, whilst the free end of the other fabric sheet (where two only are utilized), will correspond with the free end of blind material in a conventional single sheet arrangement, thus allowing the keyway tube to move or travel as the rolling apparatus is unrolled.

However, whilst this is the preferred arrangement, especially in situations such as for use in swimming pool covers, or general awning arrangements, no such limitation is actually meant in relation to the use of the invention as a whole and other arrangements, particularly for certain special awnings and the like, and where more than two sheets are utilized, more than one such end may be held in fixed location as required.

Embodiments of the invention may find practical application as pool covers, ground covers, for shading, as hot house covers, caravan annexes and extensions and so forth. In this regard, one particular embodiment utilizing three sheets of fabric, allows for a pair of sheets to form an awning or effective ceiling, whilst a third sheet may drop down from the central keyway tube to form a wall portion or divider.

It will also be appreciated in situations where the self rolling apparatus is utilized as say a swimming pool cover that there are considerable advantages in having the two sheets of material unroll from a common tube since each piece of material may be conveniently shaped to correspond to that portion of the pool over which it is to be extended.

Furthermore, it may be advantageous to provide a hood or cover arrangement over the rolling apparatus to protect it, particularly in outdoor situations.

With advantage, two or more self rolling apparatuses according to the invention may be coupled together to extend the area which may be covered. In this way, the end of one material panel will be connected by suitable means to the end of another material panel extending in opposite direction from the next adjacent rolling apparatus.

When used as a pool cover, the apparatus according to the invention has the advantage of being more fully supported than a simple rolled out tarpaulin or cover. One advantage following from this arrangement is that leaves etc are more readily kept on the cover (and so prevented from falling into the pool) so that they are transported away from the pool area and may be removed conveniently by a suitable transporting mechanism or spreader type arrangement and allowed to drop say to the side, during retraction of the mechanism. In this regard, the tension bar itself may be provided with extension pieces or arms to assist in sweeping the leaves off the cover as it rolls.

Although the cover material for a pool will be more fully supported during rolling and unrolling than a simple unsupported roll-out cover, in use, it may be allowed to rest on the pool area if desired once it is extended to reduce the tension which would be otherwise necessary to maintain if the cover were to remain above the water line.

One advantage that has been found in utilizing the invention is that creasing of the fabric as it rolls is markedly reduced where two or more fabric panels are wound up together, as compared with rolling a single panel in a conventional arrangement.

In another embodiment of the invention, an awning in which one horizontal "ceiling" panel is formed from one sheet of material, whilst a second sheet forms a vertical "wall" is envisaged. The keyway tube in this case may conveniently act as the junction of the wall and ceiling portions, being itself a rigid member to further provide stability and integrity to such a structure.

Another embodiment of the invention resides in utilizing the self rolling structure as an extendible vertical panel. In this embodiment the wheels on one end, that is to say the lower end, of the self rolling apparatus will be perpendicular to those utilized in the aforementioned embodiments. Whilst the lower wheels may run on the ground it will be found useful to have the upper wheels supported for example in a guide means, such as the wire guides previously described for the awning embodiment.

BRIEF DESCRIPTION OF THE DRAWINGS

Preferred embodiments of the invention are illustrated in the accompanying drawings of which.

BEST MODE OF CARRYING OUT THE INVENTION

Figure 1:
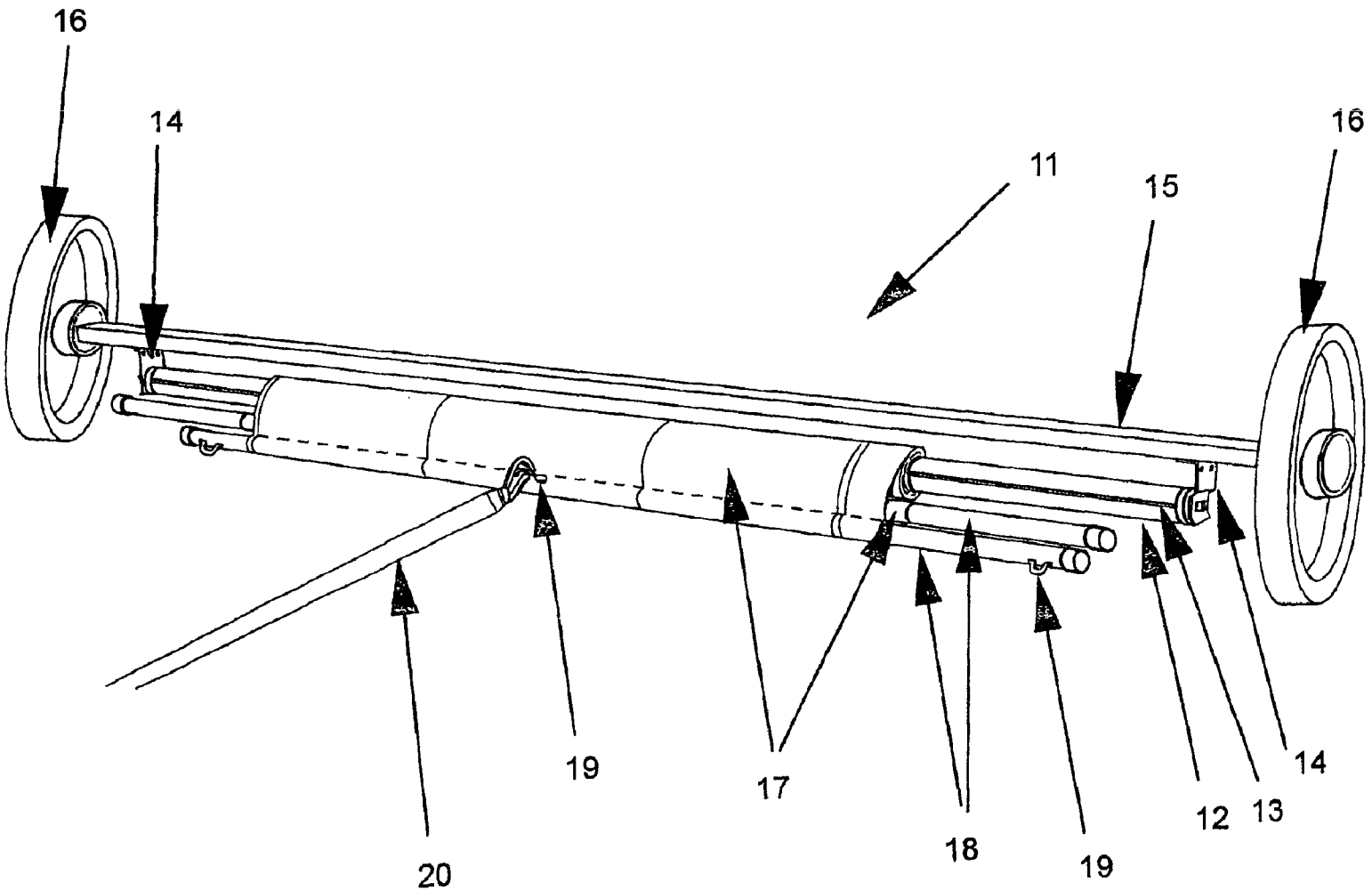
FIG. 1 is a perspective view of a rolling apparatus, especially suitable for use as a cover, according to the present invention, in the rolled up or contracted state.
Figure 2:
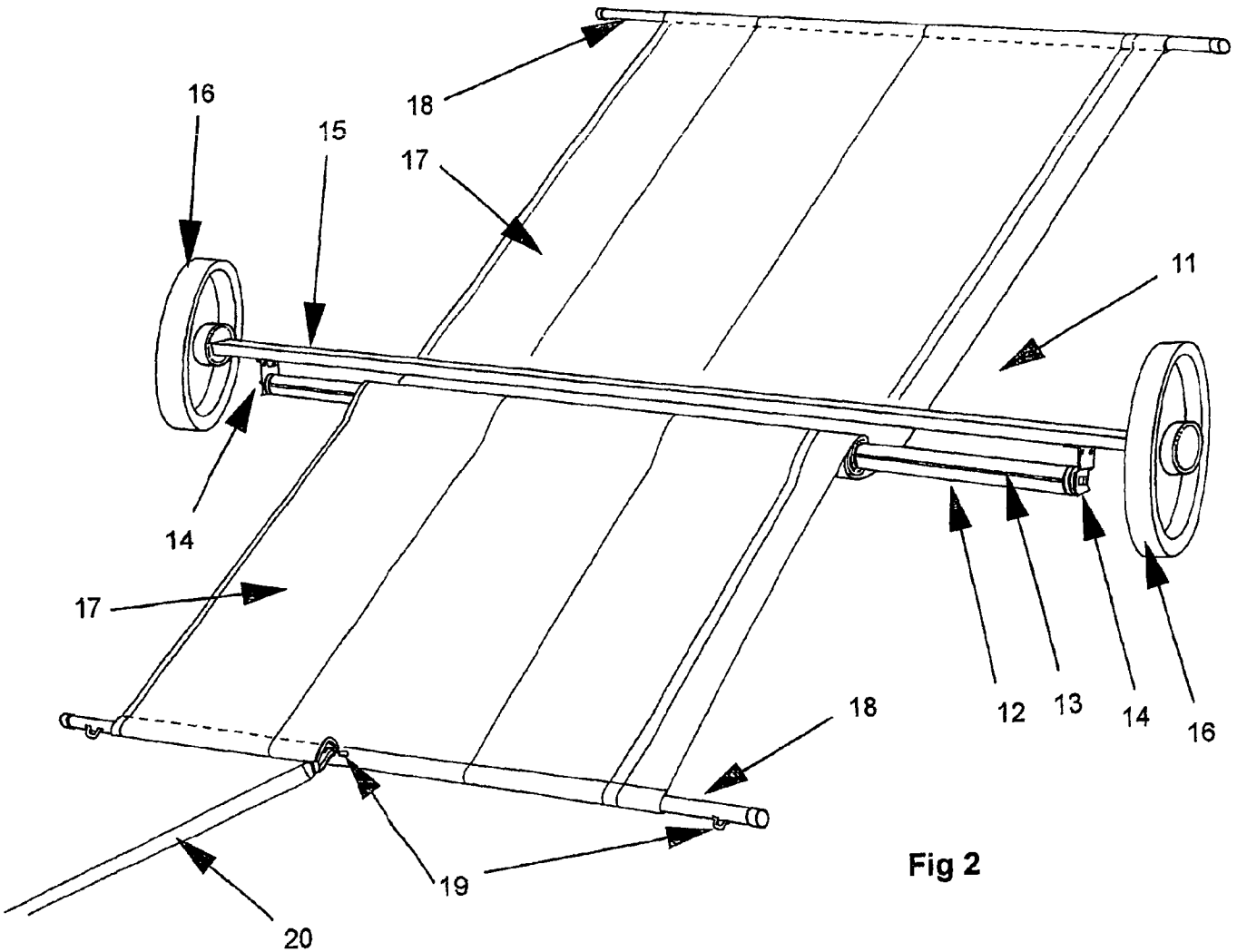
FIG. 2 is a perspective view of the rolling apparatus according to Fig., but in an unrolled or extended state.

Referring generally to the drawings and in particular to FIGS. 1 and 2 there is depicted a rolling apparatus, generally referenced 11, comprising a key-way tube 12, having a key-way 13 which runs along the length thereof. The tube 12 is supported in brackets 14, which in turn are attached to a frame member 15 which acts as a tension bar 15. Tension bar 15 is fitted at each end with wheels 16 which support the rolling apparatus 11 and allows it to roll over any suitable surface or in any suitable track (not illustrated).

Two sheets of cover material 17 are wound about key-way tube 12. The inner edges of each sheet of material 17, not visible, are fitted within the key-way slot 13 which runs along the length of the tube 12, in known fashion (except that two sheets rather than one sheet are fitted). The two sheets of material 17 are each provided with a bar member 18 at their free ends to assist in pulling the sheets and generally supporting the free ends thereof. One or more hooks 19 or similar pull facility are also provided in the vicinity of the ends of the sheets of material 17 to further facilitate grasping and pulling, or otherwise retain where appropriate, each sheet of material 17 against a fixed feature such as wall etc (not shown). In this case a pull stick 20 is utilized as illustrated on one of the hooks 19, in this case a central one at one free end of material 17, whilst the other end is retained by suitable means (not illustrated).

Although not illustrated, small pulleys or wheels may be fitted to the ends of the bar member 18 which is free to be pulled in order to assist in its travel across the relevant surface to be covered, especially where that area is relatively expansive, as this will provide some support and ease of use.

Figure 3:
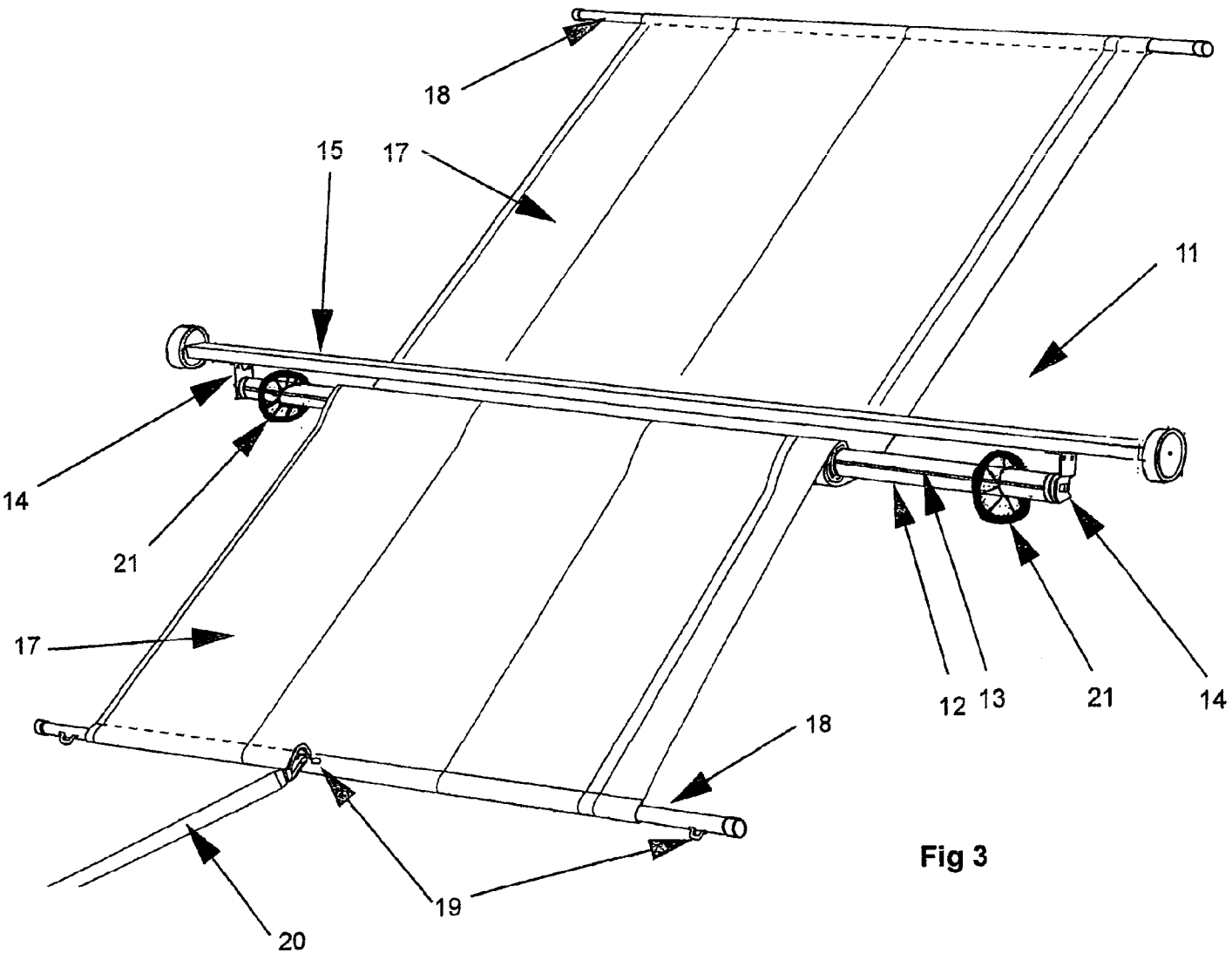
FIG. 3 is a perspective view of a similar arrangement to that shown in FIGS. 1 and 2, for use as a cover, herein shown in the extended position only, except that the wheels are located on the keyway tube itself rather than the frame work (tension bar) supporting the said tube.

Depicted in FIG. 3, is an alternate arrangement in which identical components are referenced with the same reference numerals. In this embodiment however, the wheels 16 on tension bar 15 are replaced with an alternate set of wheels 21 located instead near the ends of the key-way tube 12.

In use, the invention as illustrated in either embodiment of FIGS. 1 to 3 functions in an identical way. That is to say, in order to unroll the apparatus, it is only necessary to grasp and pull on one end of one sheet of material, whilst the free end of the other sheet of material is prevented from moving by any suitable means. As the first sheet is pulled, it causes the rolling apparatus to unwind allowing the apparatus itself to move in the direction in which the first sheet is being pulled. The apparatus is assisted in its travel by rolling on the wheels provided. Due to the geometry of the arrangement, the apparatus will travel one half of the distance spanned by the two sheets of material, that is the effective distance that the end of the first sheet itself will have travelled.

On the other hand it will be understood that the rolling apparatus itself may be kept stationery and allowed to unroll as both sheets are pulled simultaneously in opposite directions should that arrangement be more desirable in certain situations. In awning arrangements, it will also be appreciated that each free end of material may be secured against movement whilst the rolling apparatus is caused to move tangentially away from the shortest line between the two ends to form for example a wall and ceiling arrangement.

Figure 4:
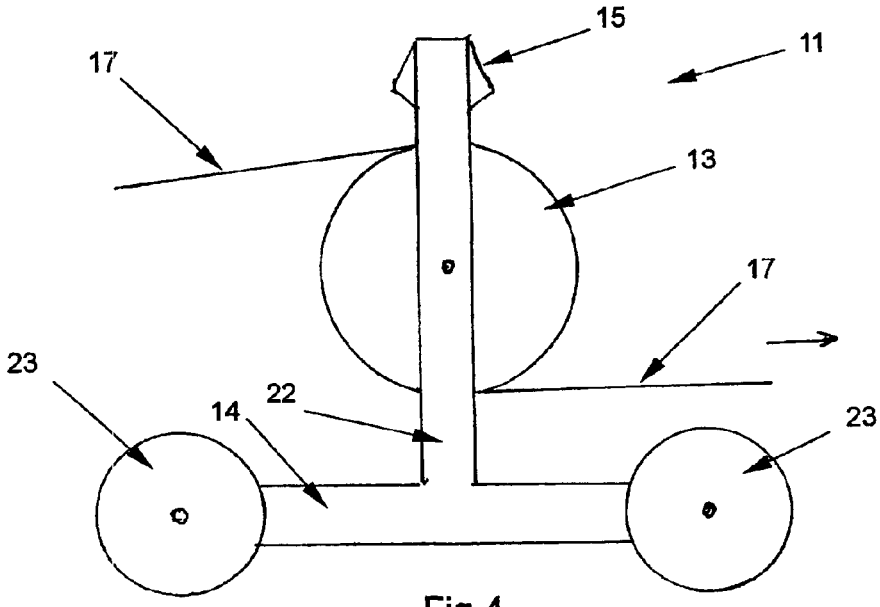
FIG. 4 is a side elevation of an alternate embodiment of the invention for use as a cover, wherein the tension bar is located above the keyway tube.
Figure 5:
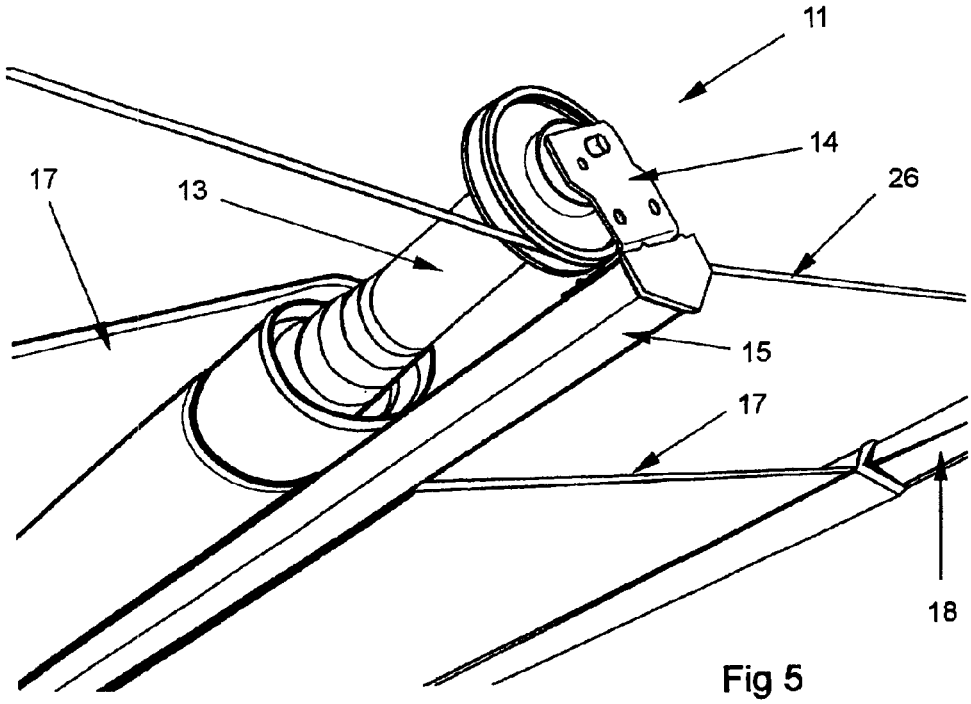
FIG. 5 is perspective view of an embodiment of the invention for use as an awning, showing the use of a pulley mounted on the keyway tube used in conjunction with a guide wire.

FIG. 4 shows an alternative embodiment suitable for use as a cover, wherein similar components to those shown in FIGS. 1 to 3 are again indicated by the same reference numerals. In this case the unit 11 comprises a keyway tube 12 with key 13 mounted in a frame structure comprising ends 22 which support the keyway tube 12 and the tension bar 15, which is mounted in this case above the keyway tube 12. Wheels 23 are located on the lower legs 24 of the side frame members 22. This arrangement has been shown to be especially stable by virtue of the location of the pair of wheels relative to the keyway tube. Referring to FIG. 5, again utilizing identical reference numerals for similar parts to those in FIGS. 1 to 4, there is shown a self rolling awning apparatus 11, comprising a keyway tube 12 having a keyway 13 therein, mounted between support brackets 14, which are mounted on the ends of tension bar 15. Two sheets of fabric 17 are affixed to and wound about the keyway tube 13. The keyway tube 13 is provided with a pulley wheel 25 which runs on guide support wire 26. An additional; guide wheel not illustrated may be located on the tension bar 15 in the vicinity of pulley 25 to facilitate the travel of unit 11, by reducing friction where the tension bar would otherwise rub on the guide wire, as it tends to twist in this embodiment, by virtue of it being suspended, rather than on the ground in previous embodiments. Otherwise the operation is identical to that described for the previous embodiments.

The foregoing describes only some embodiments of the present invention, and modifications obvious to those skilled in the art can be made thereto without departing from the scope of the present invention.

What is claimed is:

1. A self-rolling blind device comprising:

a pair of brackets attached to a tension bar; the brackets supporting between them, a tube having a retraction spring mechanism;

two sheets, each sheet having a fixed end attached to the tube, and a free end;

the tension bar supporting a rolling apparatus on which the device travels.

2. The device of claim 1, wherein:

the rolling apparatus is a pair of spaced apart wheel on which the device rolls.

3. The device of claim 1, wherein:

the free end of each sheet terminates in a bar member.

4. The device of claim 1, wherein:

at least one sheet has at the free end a bar member having one or more grasping fixtures.

5. The device of claim 1, further comprising:

a third sheet, the third sheet having a fixed end attached to the tube and a free end.

6. The device of claim 1, wherein:

the rolling apparatus support the device above a surface.

7. The device of claim 1, wherein:

the tension bar is supported above the tube by the brackets.

8. A self-rolling blind device comprising:

a pair of frame ends, between which are supported a tube having a retraction spring mechanism and a tension bar;

two or more sheets, each sheet having a fixed end attached to the tube, and a free end;

each frame end supporting one or more wheels on which the device rolls.

9. The device of claim 8, wherein:

the tension bar is supported above the tube by the frame ends.

10. The device of claim 8, wherein:

the free end of a sheet terminates in a bar member having one or more grasping fixtures.

11. The device of claim 8, wherein:

each frame end further comprises lower legs for supporting the one or more wheels.

12. A self-rolling blind device comprising:

a tension bar that supports a pair of brackets;

the brackets supporting between them a tube having a spring retraction mechanism;

two or more sheets, each sheet having a fixed end attached to the tube and a free end;

the tube having a wheel attached to each end, the wheels adapted to support the device for rolling motion.

13. The device of claim 12, wherein:

the wheels at each end of the tube support the device for rolling motion.

14. The device of claim 12, wherein:

the wheels are located on the tube and between the brackets.

15. The device of claim 12, wherein:

the wheels are pulley wheels.

16. The device of claim 15, further comprising:

guide wires for the pulley wheels to run on.

17. The device of claim 16, wherein:

the tension bar is below the tube when the device is supported by the guide wires.

* * * * *